US005937814A

United States Patent [19]

Baumer et al.

[11] Patent Number: 5,937,814

[45] Date of Patent: Aug. 17, 1999

[54] FLAME STARTING DEVICE FOR AN INTERNAL COMBUSTION ENGINE AND PROCESS FOR OPERATING THE FLAME STARTING UNIT

[75] Inventors: Andreas Baumer; Martin Eller, both of Ludwigsburg; Thomas Spannbauer, Bonnigheim; Ulrich Stephan, Erligheim, all of Germany

[73] Assignee: Beru Ruprecht GmbH & Co. KG, Ludwigsburg, Germany

[21] Appl. No.: 08/899,475

[22] Filed: Jul. 24, 1997

[30] Foreign Application Priority Data

Jul. 24, 1996 [DE] Germany ..... 196 29 928

[51] Int. Cl.[6] ..... F02N 17/047

[52] U.S. Cl. ..... 123/179.21

[58] Field of Search ..... 123/179.21, 550, 123/556

[56] References Cited

U.S. PATENT DOCUMENTS

| | | | |
|---|---|---|---|
| 3,687,122 | 8/1972 | Kamo | 123/550 |
| 3,977,376 | 8/1976 | Reid et al. | 123/550 |
| 4,624,226 | 11/1986 | Klak et al. | 123/170.21 |
| 5,138,987 | 8/1992 | Schmid et al. | 123/179.21 |
| 5,182,437 | 1/1993 | Schmid et al. | 219/270 |
| 5,372,102 | 12/1994 | Schmid et al. | 123/179.21 |
| 5,377,440 | 1/1995 | Eller et al. | 431/11 |
| 5,402,757 | 4/1995 | Eller et al. | 123/179.21 |

FOREIGN PATENT DOCUMENTS

| | | |
|---|---|---|
| 23 39 412 | 2/1975 | Germany . |
| 3602136 | 7/1987 | Germany . |
| 3701951 | 7/1987 | Germany . |
| 40 32 758 A1 | 4/1992 | Germany . |
| 295 01 494 U | 5/1995 | Germany . |
| 2 131 483 | 6/1984 | United Kingdom . |

*Primary Examiner*—Willis R. Wolfe
*Assistant Examiner*—Arnold Castro
*Attorney, Agent, or Firm*—Sixbey, Friedman, Leedom & Ferguson; David S. Safran

[57] ABSTRACT

Process for operating a flame starting unit for an internal combustion engine, especially a diesel engine with flame glow plug (1), which is located in an air intake channel of the internal combustion engine and which is supplied with fuel via a fuel line (5). The fuel supply of flame glow plug (1) is metered depending on the respective operating phase of the internal combustion engine by there being valve (2) for controlling the amount of fuel in fuel line (5) for supplying flame glow plug (1), this valve being made especially as a clocked solenoid valve which is controlled via clock signals that have a frequency and/or length which are varied depending on which of a plurality of operating phases of the internal combustion engine is occurring.

14 Claims, 4 Drawing Sheets

FLAME STARTING DEVICE FOR AN INTERNAL COMBUSTION ENGINE AND PROCESS FOR OPERATING THE FLAME STARTING UNIT

BACKGROUND OF THE INVENTION

1. Field of the Invention

The invention relates to a flame starting unit for an internal combustion engine, especially a diesel engine with a flame glow plug which is located in an air intake channel of the internal combustion engine and which is supplied with fuel via a fuel line, and to a process for operating the flame starting unit.

2. Description of Related Art

A flame starting unit with a flame glow plug of the type to which the present invention is directed is known from German Patent Applications DE 4 243 959 A1 and DE 4 243 965 A1 and their corresponding U.S. Pat. Nos. 5,377,440 and 5,402,757, respectively. Such a flame starting unit is used to enable cold starting of an internal combustion engine.

In known flame starting units, the flame glow plug is supplied using fixed fuel metering which is designed for high thermal power in idle rpm of the internal combustion engine. This results in the fact that, in internal combustion engines with small piston displacement or internal combustion engines with low compression, problems can arise in the starting phase because the flame of the flame glow plug consumes too much oxygen, and therefore, a relative oxygen shortage occurs for the engine. As the result of this oxygen shortage, sufficient combustion in the internal combustion engine does not take place; this results in formation of white smoke due to unburned fuel and condensate formation. Furthermore, if the flame glow plug has a small nozzle or diaphragm design, the fuel supply of the flame glow plug is too low at higher rpm of the internal combustion engine.

In the known flame starting units, fuel is metered only via the size of the nozzle or aperture used in the flame glow plug and the fuel pressure. The amount of fuel cannot be controlled by the flame starting unit itself. However, the fuel pressures in the different systems of the various engine and vehicle manufacturers are so different over the entire rpm range that is metering of fuel for the flame glow plug is not enough to start the internal combustion engine at very low temperatures.

SUMMARY OF THE INVENTION

The object of the invention, on the other hand, is to devise a process for operating a flame starting unit and a flame starting unit for an internal combustion engine of the initially mentioned type with which reliable operation of the internal combustion engine over the engine range of rpm is possible.

This object is achieved according to the invention in the process of the invention by the fuel supply of the flame glow plug being metered depending on the respective operating phase of the internal combustion engine.

The flame starting unit of the invention for an internal combustion engine is characterized by the fact that there is a valve for controlling the amount of fuel in the fuel line for supplying the flame glow plug.

With the invention, it is possible to reduce the fuel supply, i.e., the fuel flow to the flame glow plug for a fixed nozzle size and given preliminary pressure in the starting phase, by which starting problems due to oxygen shortage are prevented. Furthermore, it is possible to optimally meter the fuel supply of the flame glow plug over the entire rpm range.

Thus, since the flame size of the flame glow plug can be matched to the air flow rate of the internal combustion engine, the emission behavior is better and the exhaust smoke after starting the internal combustion engine is reduced.

These and further objects, features and advantages of the present invention will become apparent from the following description when taken in connection with the accompanying drawings which, for purposes of illustration only, show several embodiments in accordance with the present invention.

DETAILED DESCRIPTION OF THE PREFERRED EMBODIMENT

Figure 3:
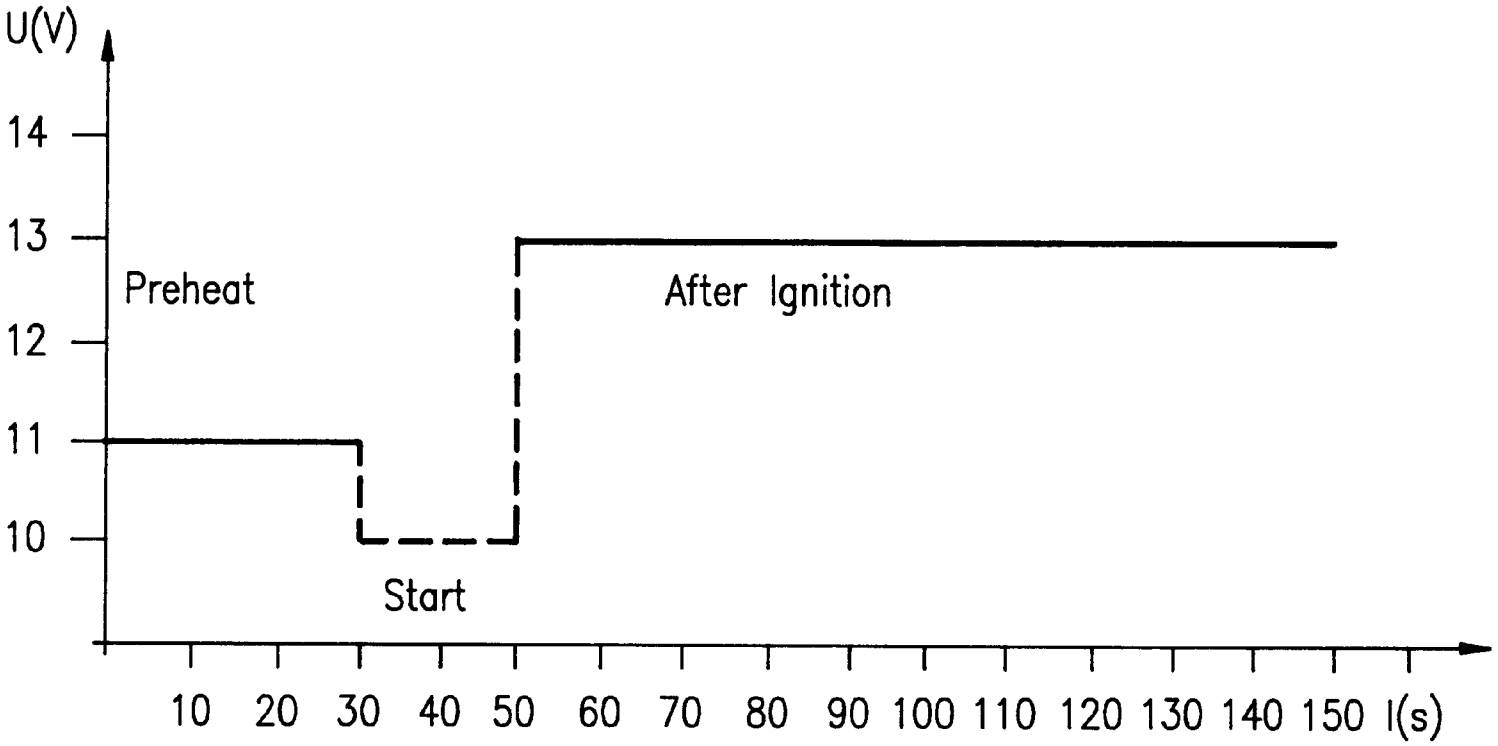
FIG. 3 is a graph depicting operation of the flame starting unit, especially of the flame glow plug in the different operating phases of an internal combustion engine over time.

As is shown in FIG. 3, in cold starting of an internal combustion engine, especially a diesel engine, the flame glow plug of a flame starting unit is preheated first for 20 to 30 seconds. After the preheating time, by actuating the starter and the starting motor of the internal combustion engine, fuel supply to the flame glow plug begins and the flame is ignited by the air taken into the air intake channel and the fuel prepared by the flame glow plug. An after-ignition phase follows the starting phase.

So that the flame on the flame glow plug does not burn too much oxygen, especially in the starting phase and at low rpm of the internal combustion engine, the level of fuel supply of the flame glow plug is metered accordingly, depending on the respective operating phase of the internal combustion engine. This means, in particular, that the fuel flow to the flame glow plug in the starting phase and at low rpm is reduced in order to thus reduce the fuel consumption.

Figure 1:
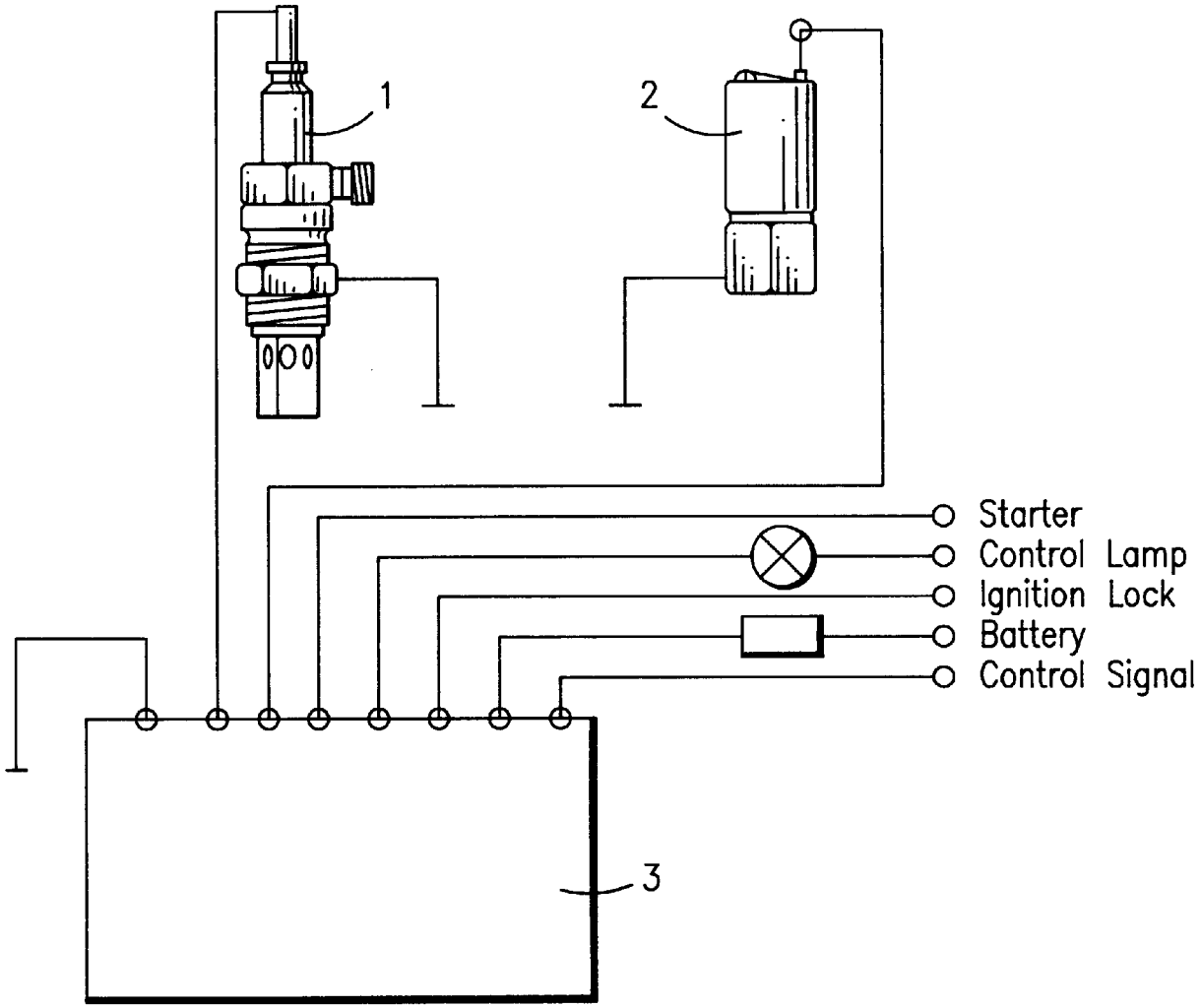
FIG. 1 shows a schematic of the structure of a flame starting unit.
Figure 2:
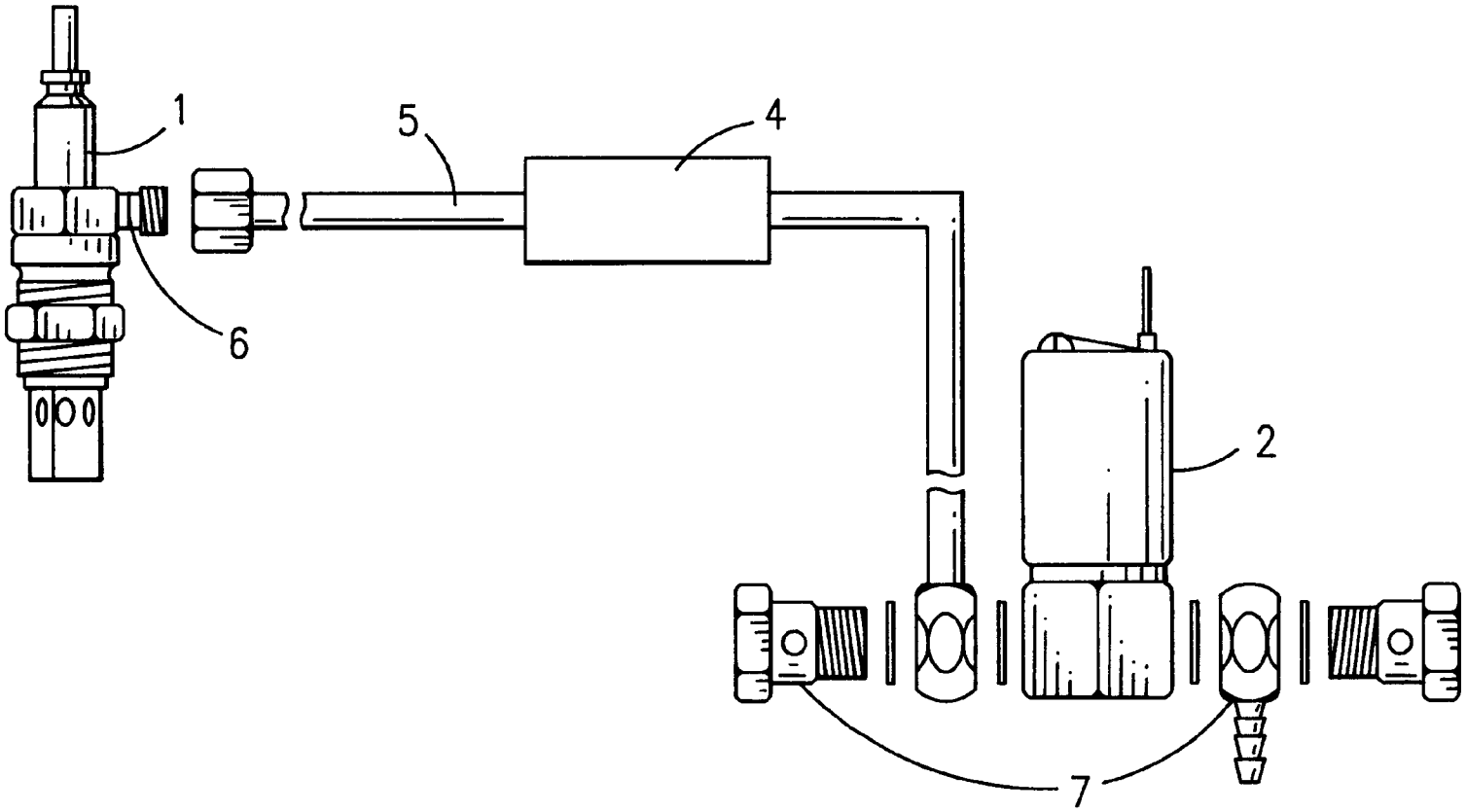
FIG. 2 shows the fuel supply part of the flame glow plug of the flame starting unit shown in FIG. 1.

To do this, the flame starting unit shown in FIGS. 1 and 2, which has flame glow plug 1 which is supplied with fuel via fuel line 5, is provided with a valve for controlling the amount of fuel, specifically, solenoid valve 2 which is located in fuel line 5 to supply the flame glow plug. Solenoid valve 2 is controlled via control part 3 such that the fuel supply for the flame glow plug is choked, especially in the starting phase and at low rpm of the internal combustion engine, so that the flame which occurs on the flame glow plug does not consume too much oxygen.

In the embodiment shown in FIGS. 1 and 2, clock signals which are produced by control part 3, depending on the respective operating phases, are applied to solenoid valve 2. In particular, control part 3 can deliver clock signals with a variable clock frequency fx and/or clock length tx, i.e., the opening time of solenoid valve 2.

Figure 4:
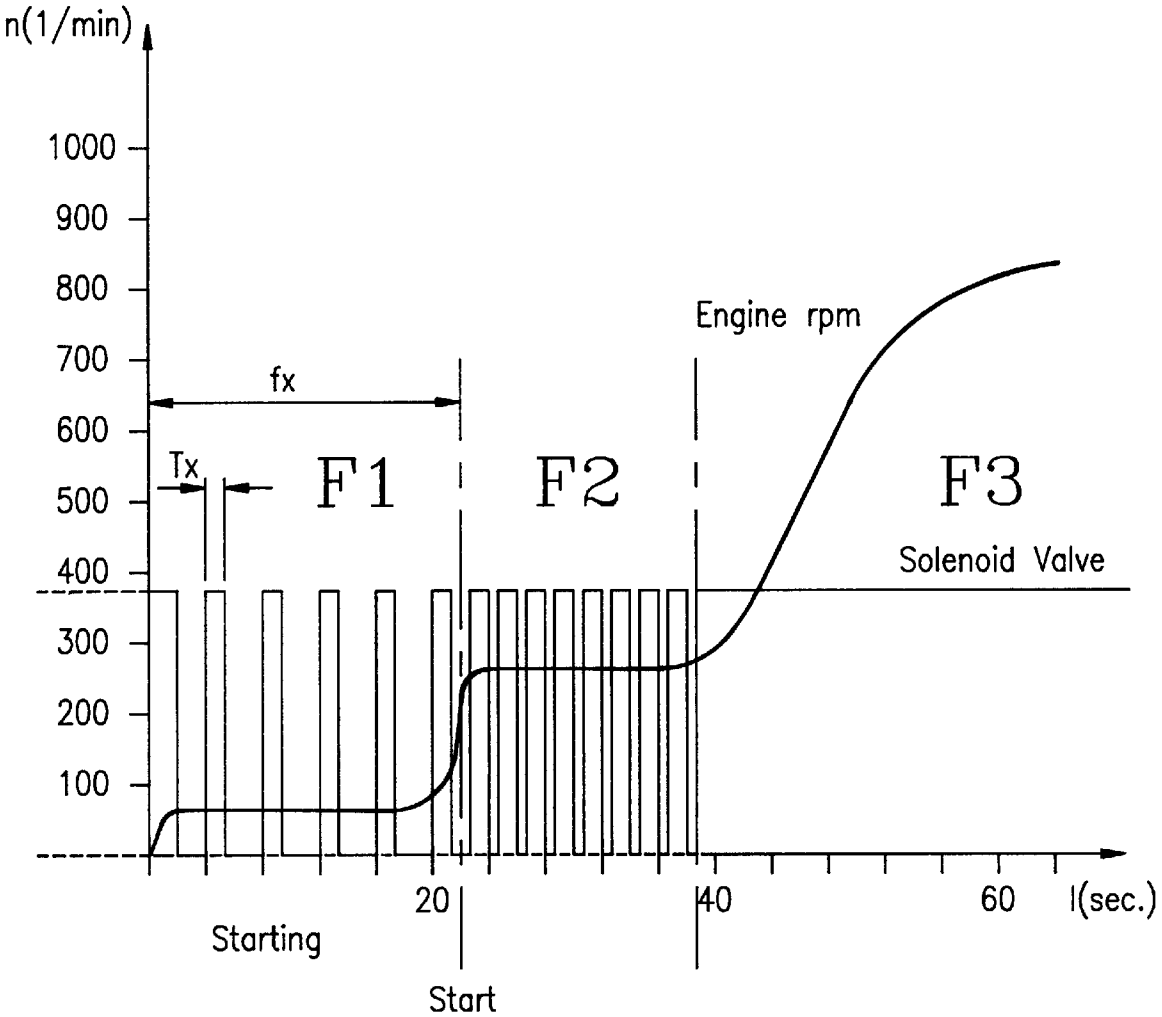
FIG. 4 is a graph of the clock signals on the solenoid valve of the flame starting unit in FIG. 1 over time.

As is shown in FIG. 4, in the starting phase F1, clock signals with a relatively low clock frequency fx are sent from control part 3 to solenoid valve 2 so that the level of fuel supply to flame glow plug 1 is reduced accordingly. In a subsequent range F2, after starting the internal combustion engine, the clock frequency fx of the clock signal from control part 3 increases, and thus the level of fuel supply of flame glow plug 1 increases. Above these rpm ranges, depending on the control part, different clock frequencies can be used to control or meter the level of fuel supply of flame glow plug 1. If, after roughly 40 seconds, the internal combustion engine is running with higher rpm, via acquisition of the respective rpm of the internal combustion engine, clocking of solenoid valve 2 can be ended so that the solenoid valve 2 is constantly open, as shown in range F3.

As is shown in particular in FIG. 2, a hose which forms a part of fuel supply line 5 between solenoid valve 2 and flame glow plug 1 acts as a buffer, but there can also be fuel reservoir 4 in fuel supply line 5 between flame glow plug 1 and solenoid valve 2. Furthermore, there can be choke apertures 6, 7 in front of and/or behind solenoid valve 2 and/or in front of flame glow plug 1. The buffer, the fuel reservoir and the choke apertures provide for uniform fuel flow and fuel decrease, and thus, reduce flame pulsing on flame glow plug 1. Choke apertures 6 and 7 are designed to choke the pressure, similarly to a delay element.

By means of a flame starting unit with the above described structure over the entire rpm range of the internal combustion engine and in different pressure states in fuel supply of the flame glow plug, its combustion behavior is stabilized and optimized such that improved cold starting properties of the internal combustion engine result and emissions in hot running operation and idle and push operation are reduced.

These and further objects, features and advantages of the present invention will become apparent from the following description when taken in connection with the accompanying drawings which, for purposes of illustration only, show several embodiments in accordance with the present invention.

We claim:

1. Process for operating a flame starting unit for an internal combustion engine with a flame glow plug which is located in an air intake channel of the internal combustion engine and which is supplied with fuel, comprising the steps of operating the internal combustion engine in a plurality of phases; and metering the fuel supply to the flame glow plug at rates which vary in a manner which are in dependence upon engine performance in the respective operating phase of the internal combustion engine; wherein said phases comprise a pre-ignition starting phase, and at least one after-ignition engine running phase during which a quantity of air is supplied through said air intake channel and a quantity of fuel is metered to the glow plug; where the quantity of fuel metered during said starting phase is reduced relative to the quantity of fuel metered during said at least one after-ignition engine running phase in a manner lowering the amount of oxygen consumed to a level preventing creation of an oxygen shortage in the engine and resulting formation of white smoke.

2. Process as claimed in claim 1, wherein the internal combustion engine being operated is a diesel engine.

3. Process as claimed in claim 2, wherein varying of the fuel supply rate to the flame glow plug is performed by varying of at least one of clock signal frequencies and clock signal lengths selected depending on the respective operating phase of the internal combustion engine, the clock signal frequencies and clock signal lengths being fixed during said starting phase.

4. Process as claimed in claim 3, wherein said at least one of clock signal frequencies and clock signal lengths are selected by a controller as a function of engine rpm and are used to control on-off timing of a solenoid valve.

5. Flame starting unit for an internal combustion engine with a flame glow plug which is located in an air intake channel of the internal combustion engine and which is supplied with fuel via a fuel line, wherein a valve provided for controlling an amount of fuel in the fuel line for supplying of the flame glow plug; a control part for adjusting said valve in a manner causing the valve to supply an amount of fuel during a pre-ignition starting phase which is less than an amount of fuel supplied in at least one after-ignition engine running phase, said amount of fuel supplied during the pre-ignition starting phase being lowered to a level limiting the amount of oxygen consumed by a flame produced by the glow plug to a level preventing creation of an oxygen shortage in the engine and resulting formation of white smoke.

6. Flame starting unit as claimed in claim 5, wherein the valve for controlling the amount of fuel is a clocked solenoid valve, and wherein said control part issues clock signals to the solenoid valve with at least one of a clock frequency and clock length which varies in dependence on a respective, current one of a plurality of different operating phases of the internal combustion engine.

7. Flame starting unit as claimed in claim 6, wherein a buffer means is located in the fuel line between the solenoid valve and the flame glow plug.

8. Flame starting unit as claimed in claim 7, wherein the buffer means is a fuel reservoir.

9. Flame starting unit as claimed in claim 8, wherein choke apertures are located in the fuel line upstream of the flame glow plug for controlling the amount of fuel supplied thereto.

10. Flame starting unit as claimed in claim 9, wherein the choke apertures include at least one choke aperture in the fuel line downstream of the solenoid valve for controlling the amount of fuel supplied to the flame glow plug.

11. Flame starting unit as claimed in claim 10, wherein the choke apertures include a choke aperture in the fuel line upstream of the solenoid valve for controlling the amount of fuel supplied to the flame glow plug.

12. Flame starting unit as claimed in claim 5, wherein choke apertures are located in the fuel line upstream of the flame glow plug for controlling the amount of fuel supplied thereto.

13. Flame starting unit as claimed in claim 12, wherein the choke apertures include at least one choke aperture in the fuel line downstream of the solenoid valve for controlling the amount of fuel supplied to the flame glow plug.

14. Flame starting unit as claimed in claim 11, wherein the internal combustion engine is a diesel engine.

* * * * *